US012638246B2

(12) United States Patent
Liu et al.

(10) Patent No.: US 12,638,246 B2
(45) Date of Patent: May 26, 2026

(54) THREE-DIMENSIONAL HEAT EXCHANGER

(71) Applicant: PURPLE CLOUD DEVELOPMENT PTE. LTD., Singapore (SG)

(72) Inventors: Lei Lei Liu, Hui Zhou (CN); Xue Mei Wang, Hui Zhou (CN)

(73) Assignee: PURPLE CLOUD DEVELOPMENT PTE. LTD., Singapore (SG)

( * ) Notice: Subject to any disclaimer, the term of this patent is extended or adjusted under 35 U.S.C. 154(b) by 196 days.

(21) Appl. No.: 18/222,790

(22) Filed: Jul. 17, 2023

(65) Prior Publication Data

US 2023/0358482 A1 Nov. 9, 2023

Related U.S. Application Data

(63) Continuation-in-part of application No. 17/233,463, filed on Apr. 17, 2021, now Pat. No. 11,747,089.

(30) Foreign Application Priority Data

Nov. 24, 2020 (CN) ..... 202011327804.4

(51) Int. Cl.
*F28D 15/02* (2006.01)
*F28D 15/04* (2006.01)

(52) U.S. Cl.
CPC ..... *F28D 15/0275* (2013.01); *F28D 15/04* (2013.01)

(58) Field of Classification Search
CPC .... F28D 15/0233; F28D 15/046; F28D 15/04; F28D 15/02; F28D 15/0275; F28D 2240/00; F28F 2215/06; F28F 3/06
See application file for complete search history.

(56) References Cited

U.S. PATENT DOCUMENTS

2009/0025910 A1 1/2009 Hoffman
2010/0071879 A1* 3/2010 Hou ..... F28D 15/046 29/890.032
2015/0041103 A1* 2/2015 Kiley ..... F28D 15/0233 165/104.26
2017/0082378 A1 3/2017 Wang
2019/0049190 A1* 2/2019 Liu ..... F28F 1/325
2019/0343021 A1 11/2019 Zhang
2020/0355444 A1 11/2020 Chen

FOREIGN PATENT DOCUMENTS

TW I690138 B 4/2020
TW 202221274 A 6/2022
TW M636776 U 1/2023

* cited by examiner

*Primary Examiner* — Jianying C Atkisson
*Assistant Examiner* — Khaled Ahmed Ali Al Samiri
(74) *Attorney, Agent, or Firm* — Merchant & Gould P.C

(57) ABSTRACT

A three-dimensional heat exchanger includes a thermally conductive casing, a thermally conductive structure, a first heat pipe and a second heat pipe. The thermally conductive casing includes a bottom plate and a thermally conductive protrusion structure. The bottom plate has a first inner surface. The thermally conductive protrusion structure has a second inner surface. The thermally conductive structure is disposed on the thermally conductive protrusion structure, and has a top surface. The first heat pipe contacts the first inner surface. The second heat pipe contacts the second inner surface. An end of the first heat pipe and an end of the second heat pipe have a bottom surface, respectively. A distance between the two bottom surfaces and the second inner surface is larger than a distance between the top surface and the second inner surface.

12 Claims, 8 Drawing Sheets

THREE-DIMENSIONAL HEAT EXCHANGER

CROSS-REFERENCE TO RELATED APPLICATIONS

This non-provisional application claims priority under 35 U.S.C. § 119(a) on Patent Application No(s). 202310819850.3 filed in China, on Jul. 5, 2023, this application is a continuation-in-part of U.S. patent application Ser. No. 17/233,463, filed on Apr. 17, 2021, which claims priority under 35 U.S.C. § 119(a) on Patent Application No(s). 202011327804.4 filed in China on Nov. 24, 2020, the entire contents of which are hereby incorporated by reference.

TECHNICAL FIELD

The disclosure relates to a heat exchanger, more particularly to a three-dimensional heat exchanger.

BACKGROUND

In general, a heat pipe only transfers heat in one dimension (i.e., the axis of the heat pipe), and a vapor chamber can be regard as a planar heat pipe that can transfer heat in two dimensions and thus can transfer heat in a more efficient manner. The vapor chamber mainly includes a plate body and a capillary structure. The plate body has a chamber filled with a working fluid. The capillary structure is accommodated in the chamber of the plate body. A part of the plate body that is heated defines an evaporation space of the chamber, and the remaining part of the plate body defines a condensation space of the chamber. The working fluid in the evaporation space is evaporated into vapor, and then flows to the condensation space due to the pressure difference. The working fluid flowing to the condensation space is condensed into liquid and then flows backwards to the evaporation space with the help of the capillary structure, thereby completing a cycle.

Generally, conventional heat dissipation system or assembly includes both of the heat pipe and the vapor chamber, the heat pipe and the vapor chamber are independent from one another, and the heat pipe and the vapor chamber transfer heat in one dimension or in two dimensions, such that the heat transfer efficiency of the heat dissipation system or assembly is hard to be further improved. Recently, manufacturers integrates the heat pipe and the vapor chamber as a single piece to produce a three-dimensional heat exchanger. However, a heat transfer efficiency of the conventional three-dimensional heat exchanger is still insufficient to meet requirements of users. Therefore, how to further improve the heat transfer efficiency of the three-dimensional heat exchanger is an important issue to be solved.

SUMMARY

The disclosure provides a three-dimensional heat exchanger having an improved heat transfer efficiency.

One embodiment of this disclosure provides a three-dimensional heat exchanger including a first thermally conductive casing, a second thermally conductive casing, at least one thermally conductive structure, at least one first heat pipe and at least one second heat pipe. The second thermally conductive casing is disposed on the first thermally conductive casing. The first thermally conductive casing and the second thermally conductive casing together form a liquid-tight chamber. The second thermally conductive casing includes a bottom plate and a thermally conductive protrusion structure. The thermally conductive protrusion structure protrudes from the bottom plate toward a direction away from the first thermally conductive casing. The bottom plate has a first inner surface. The thermally conductive protrusion structure has a second inner surface. The first inner surface and the second inner surface face the first thermally conductive casing. The at least one thermally conductive structure is located in the liquid-tight chamber and is disposed on the thermally conductive protrusion structure. The at least one thermally conductive structure has a top surface. The top surface faces the first thermally conductive casing. The at least one first heat pipe and the at least one second heat pipe are disposed through the first thermally conductive casing. The at least one first heat pipe contacts the first inner surface. The at least one second heat pipe contacts the second inner surface. An end of the at least one first heat pipe and an end of the at least one second heat pipe each have an opening and at least one notch. The opening is in fluid communication with the liquid-tight chamber. The at least one notch is located at the opening. The at least one notch is in fluid communication with the opening. The at least one notch of the at least one first heat pipe and the at least one notch of the at least one second heat pipe each have a bottom surface. The two bottom surfaces of the at least one first heat pipe and the at least one second heat pipe face the first inner surface and the second surface, respectively. A distance between each of the two bottom surfaces of the at least one first heat pipe and the at least one second heat pipe and the second inner surface is larger than a distance between the top surface and the second inner surface.

According to the three-dimensional heat exchangers disclosed by the above embodiments, since the distance between each of the bottom surfaces of the first heat pipes and the second inner surface of the thermally conductive protrusion structure and the distance between each of the bottom surfaces of the second heat pipes and the second inner surface of the thermally conductive protrusion structure are larger than the distance between the top surface of each of the thermally conductive structures and the second inner surface of the thermally conductive protrusion structure, the working fluid absorbing the heat from the heat source to be vaporized can be accelerated to flow into the first heat pipes and the second heat pipes. Therefore, the efficiency of heat dissipation can be improved.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
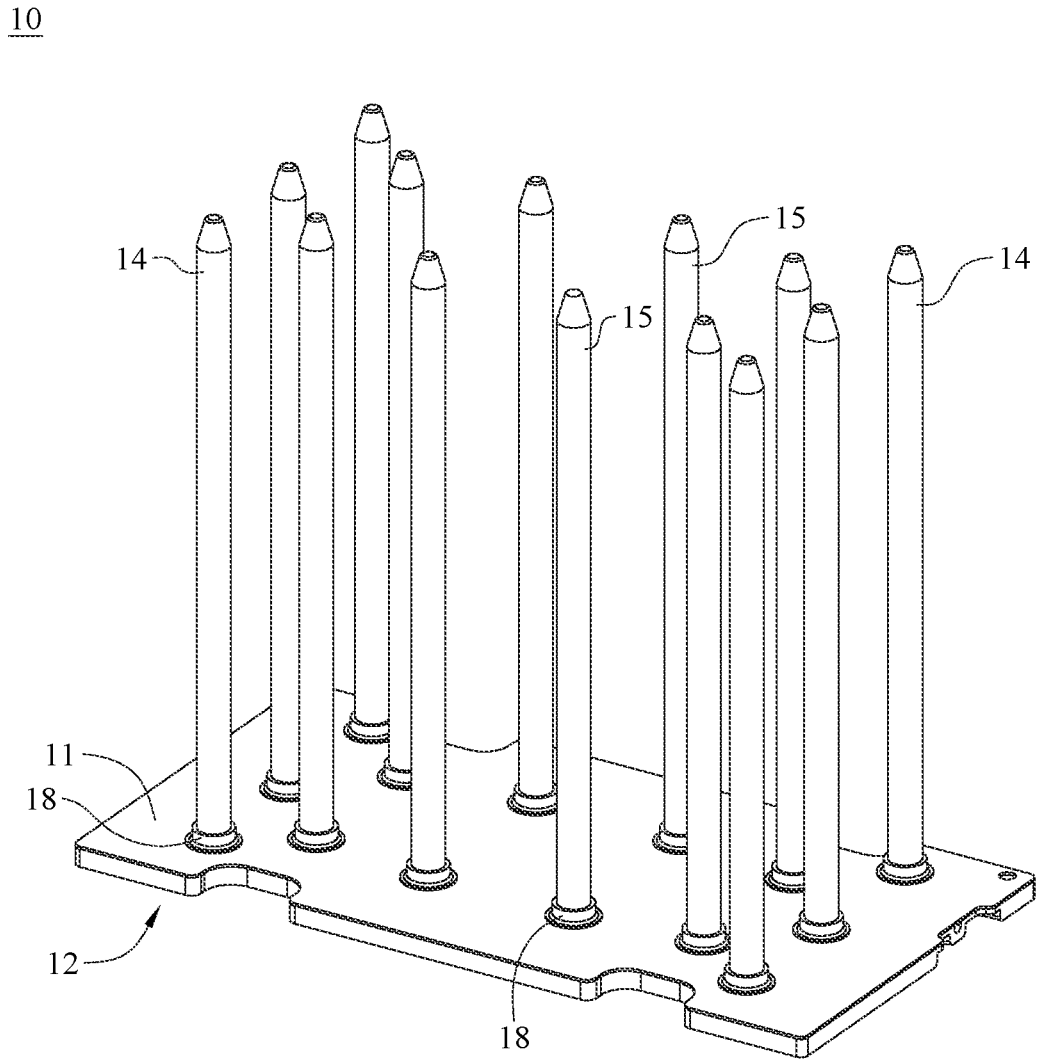
FIG. 1 is a perspective view of a three-dimensional heat exchanger according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
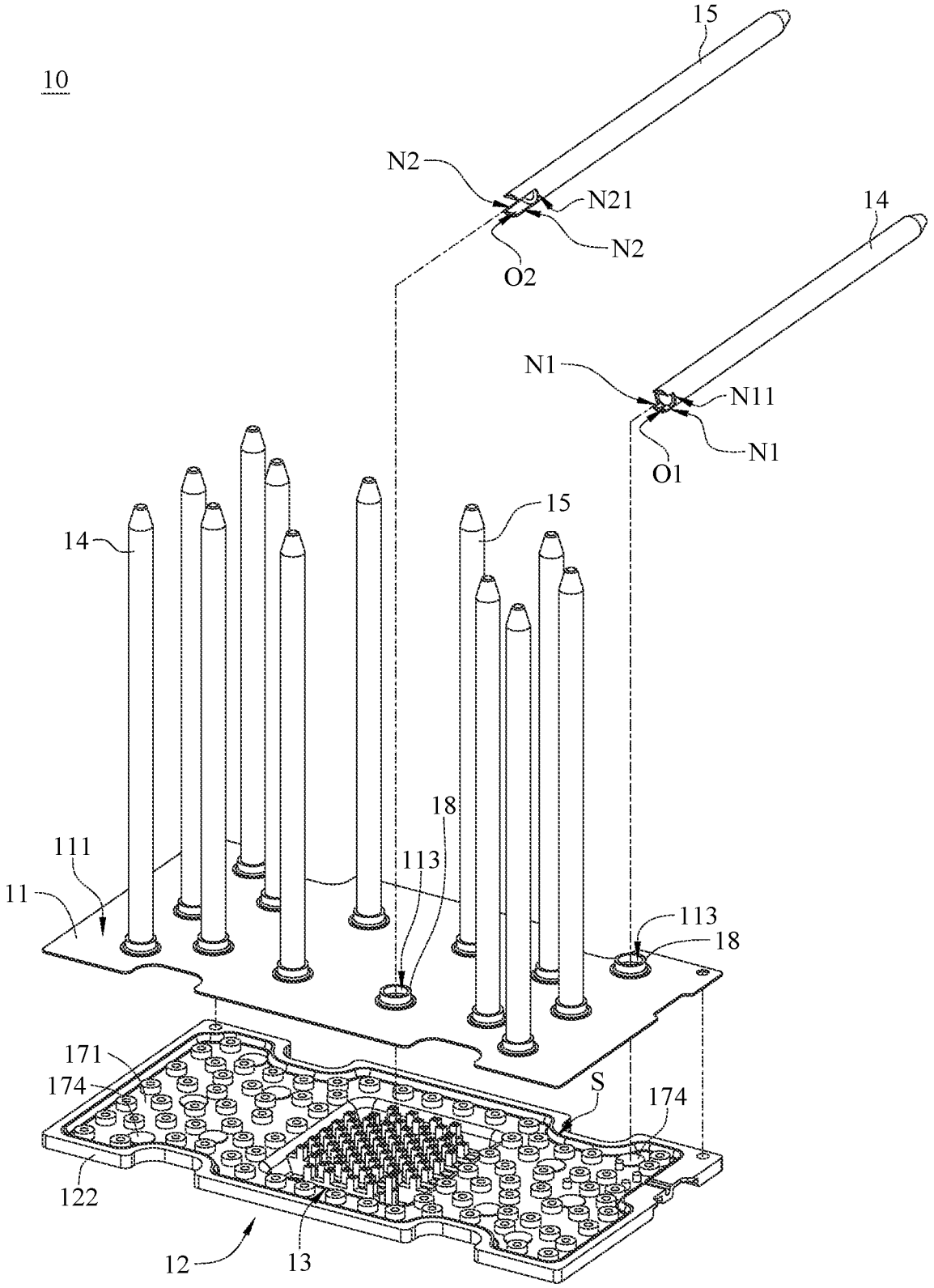
FIG. 2 is an exploded view of the three-dimensional heat exchanger in FIG. 1.
Figure 3:
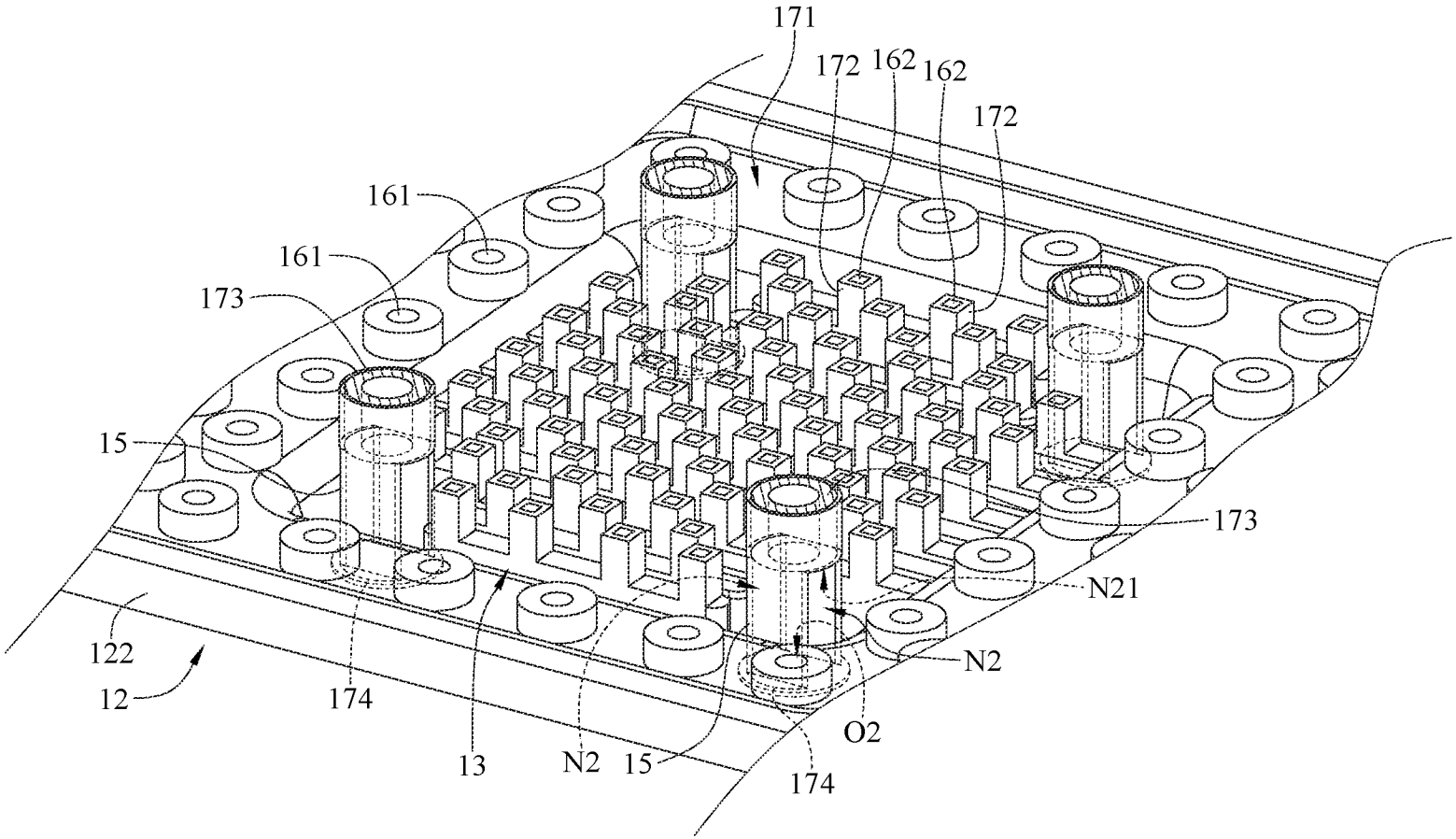
FIG. 3 is a partially sectional view of the three-dimensional heat exchanger in FIG. 1.

Please refer to FIG. 1 to FIG. 3, where FIG. 1 is a perspective view of a three-dimensional heat exchanger 10 according to a first embodiment of the disclosure, FIG. 2 is an exploded view of the three-dimensional heat exchanger 10 in FIG. 1, and FIG. 3 is a partially sectional view of the three-dimensional heat exchanger 10 in FIG. 1.

In this embodiment, the three-dimensional heat exchanger 10 includes a first thermally conductive casing 11, a second thermally conductive casing 12, a plurality of thermally conductive structures 13, a plurality of first heat pipes 14, a plurality of second heat pipes 15, a plurality of first supporting structures 161, a plurality of second supporting structures 162, a plurality of second capillary structures 171, a third capillary structure 172, a plurality of fourth capillary structures 173 and a plurality of fifth capillary structures 174.

The second thermally conductive casing 12 is disposed on the first thermally conductive casing 11, so that the first thermally conductive casing 11 and the second thermally conductive casing 12 together form a liquid-tight chamber S. The liquid-tight chamber S is configured to accommodate a working fluid (not shown). The working fluid is, for example, water or refrigerant. The second thermally conductive casing 12 includes a bottom plate 121, an annular side wall 122 and a thermally conductive protrusion structure 123.

Figure 7:
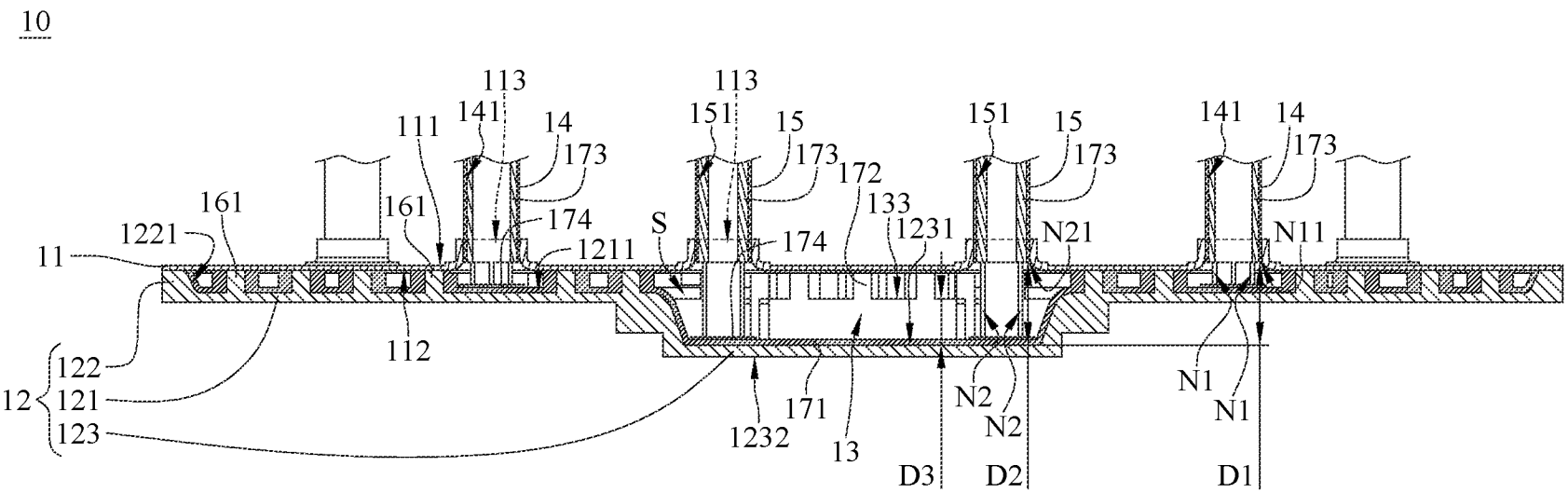
FIG. 7 is a cross-sectional view of the three-dimensional heat exchanger in FIG. 1.

Please refer to FIG. 1 to FIG. 3 and FIG. 7, where FIG. 7 is a cross-sectional view of the three-dimensional heat exchanger 10 in FIG. 1. The annular side wall 122 is connected to a periphery of the bottom plate 121. The thermally conductive protrusion structure 123 protrudes from the bottom plate 121 toward a direction away from the first thermally conductive casing 11. The bottom plate 121 has a first inner surface 1211. The thermally conductive protrusion structure 123 has a second inner surface 1231 and a heat exchanging surface 1232. The first inner surface 1211 and the second inner surface 1231 face the first thermally conductive casing 11. The heat exchanging surface 1232 faces away from the second inner surface 1231, and is configured to be thermally coupled to a heat source (not shown), so that the working fluid located in the liquid-tight chamber S can absorb a heat transferred from the heat source to the thermally conductive protrusion structure 123 via the heat exchanging surface 1232. The so-called "thermally coupled" refers to a thermal contact or a connection via other thermally conductive media.

Figure 4:
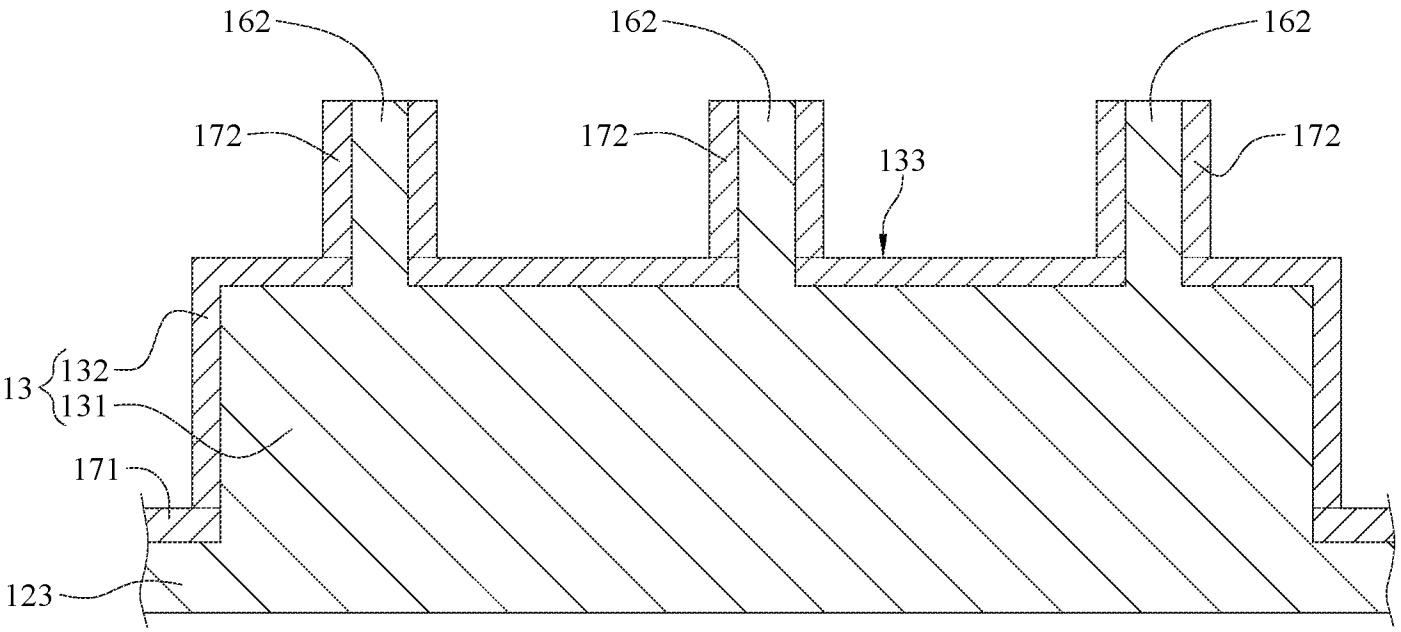
FIG. 4 is a partially enlarged and cross-sectional view of the three-dimensional heat exchanger in FIG. 1.

Please refer to FIG. 1 to FIG. 4 and FIG. 7, where FIG. 4 is a partially enlarged and cross-sectional view of the three-dimensional heat exchanger 10 in FIG. 1. The plurality of thermally conductive structures 13 are located in the liquid-tight chamber S, and is disposed on the thermally conductive protrusion structure 123. The thermally conductive structures 13 are parallel to one another. The thermally conductive structures 13 can cause desired vapor pressure drop and reduce the high liquid pressure drop caused by the capillary structures in the liquid-tight chamber S so as to improve the efficiency of heat dissipation. Each of the thermally conductive structures 13 includes a body portion 131 and a first capillary structure 132, and had a top surface 133. The first capillary structure 132 is stacked on the body portion 131. The top surface 133 is located on the first capillary structure 132, and faces the first thermally conductive casing 11. Accordingly, after the working fluid absorbs the heat from the heat source to be vaporized, it can flow backwards via the first capillary structure 132.

The first thermally conductive casing 11 has an upper surface 111 and a plurality of through holes 113. The upper surface 111 faces away from the liquid-tight chamber S. The through holes 113 are located on the upper surface 111. The first heat pipes 14 and the second heat pipes 15 are disposed through the through holes 113. The first heat pipes 14 contacts the first inner surface 1211 of the bottom plate 121. The second heat pipes 15 contacts the second inner surface 1231 of the thermally conductive protrusion structure 123.

An end of each of the first heat pipes 14 has an opening O1 and two notches N1, and an end of each of the second heat pipes 15 has an opening O2 and two notches N2. The openings O1 and O2 are in fluid communication with the liquid-tight chamber S. The notches N1 and N2 are located at the openings O1 and O2, respectively, and the notches N1 and N2 are in fluid communication with the openings O1 and O2, respectively.

The notches N1 and N2 are configured to allow the working fluid to flow into the first heat pipes 14 and the second heat pipes 15. Each notch N1 of the first heat pipes 14 has a bottom surface N11, and each notch N2 of the plurality of second heat pipes 15 has a bottom surface N21. The bottom surfaces N11 and N21 face the first inner surface 1211 and the second inner surface 1231, respectively. A distance D1 between each of the bottom surfaces N11 and the second inner surface 1231 and a distance D2 between each of the bottom surfaces N21 and the second inner surface 1231 are larger than a distance D3 between the top surface 133 and the second inner surface 1231.

Specifically, the distance D1 is equal to a distance D2. In addition, each of the bottom surfaces N11 and N21 is, for example, located above the upper surface 111 of the first thermally conductive casing 11. Accordingly, the working fluid can be accelerated to flow into the first heat pipes 14 and the second heat pipes 15 so as to improve the efficiency of heat dissipation.

Figure 5:
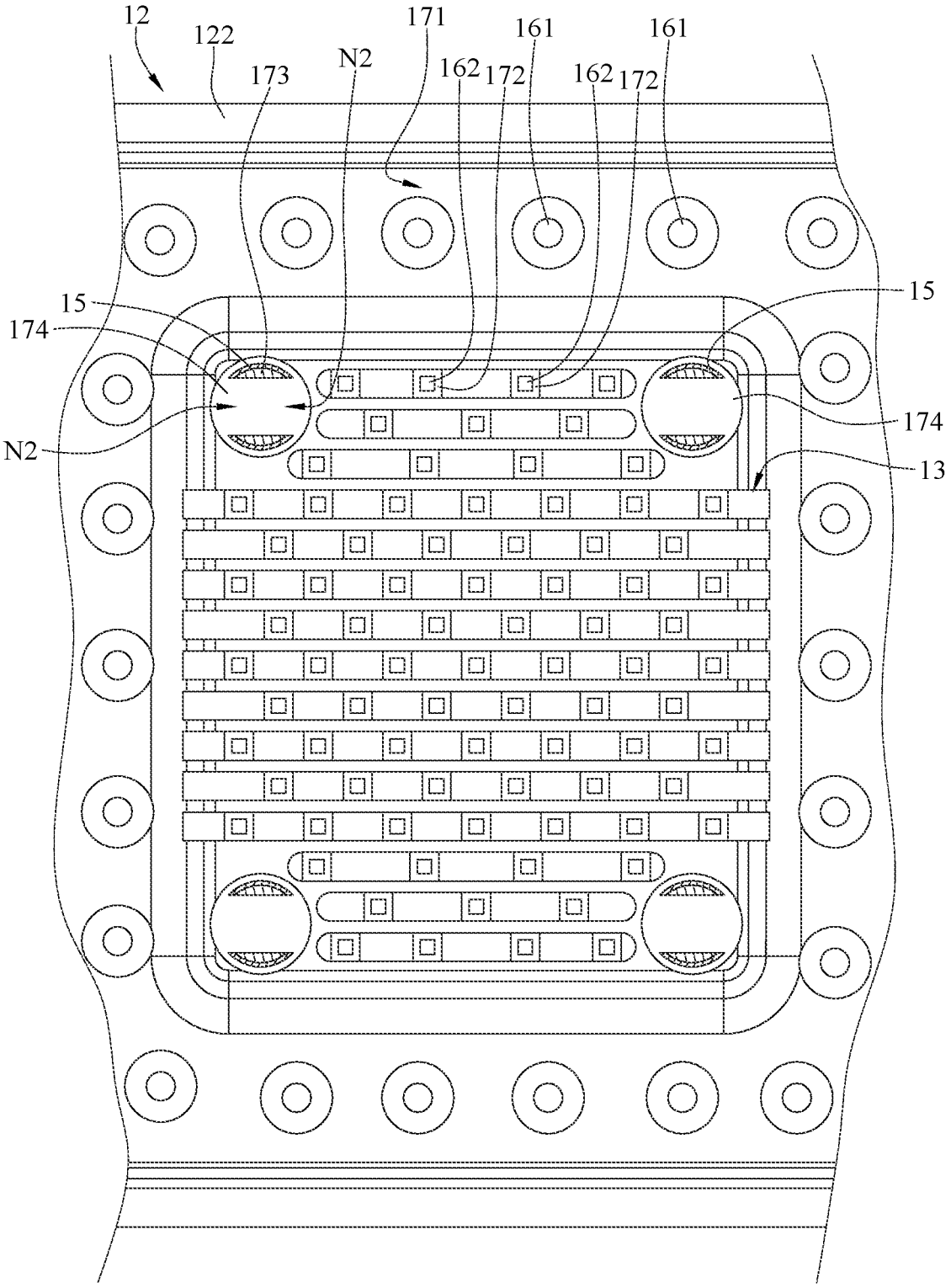
FIG. 5 is another partially enlarged and cross-sectional view of the three-dimensional heat exchanger in FIG. 1.

Please refer to FIG. 3 to FIG. 5, where FIG. 5 is another partially enlarged and cross-sectional view of the three-dimensional heat exchanger 10 in FIG. 1. In this embodiment, the notches N1 and N2 are in fluid communication with recesses between the thermally conductive structures 13, such that after the working fluid absorbs the heat to be vaporized, the working fluid can flow toward the notches N1 and N2 through the recesses between the thermally conductive structures 13, and then flows into the first heat pipes 14 and the second heat pipes 15 through the notches N1 and N2 to dissipate the heat.

Figure 6:
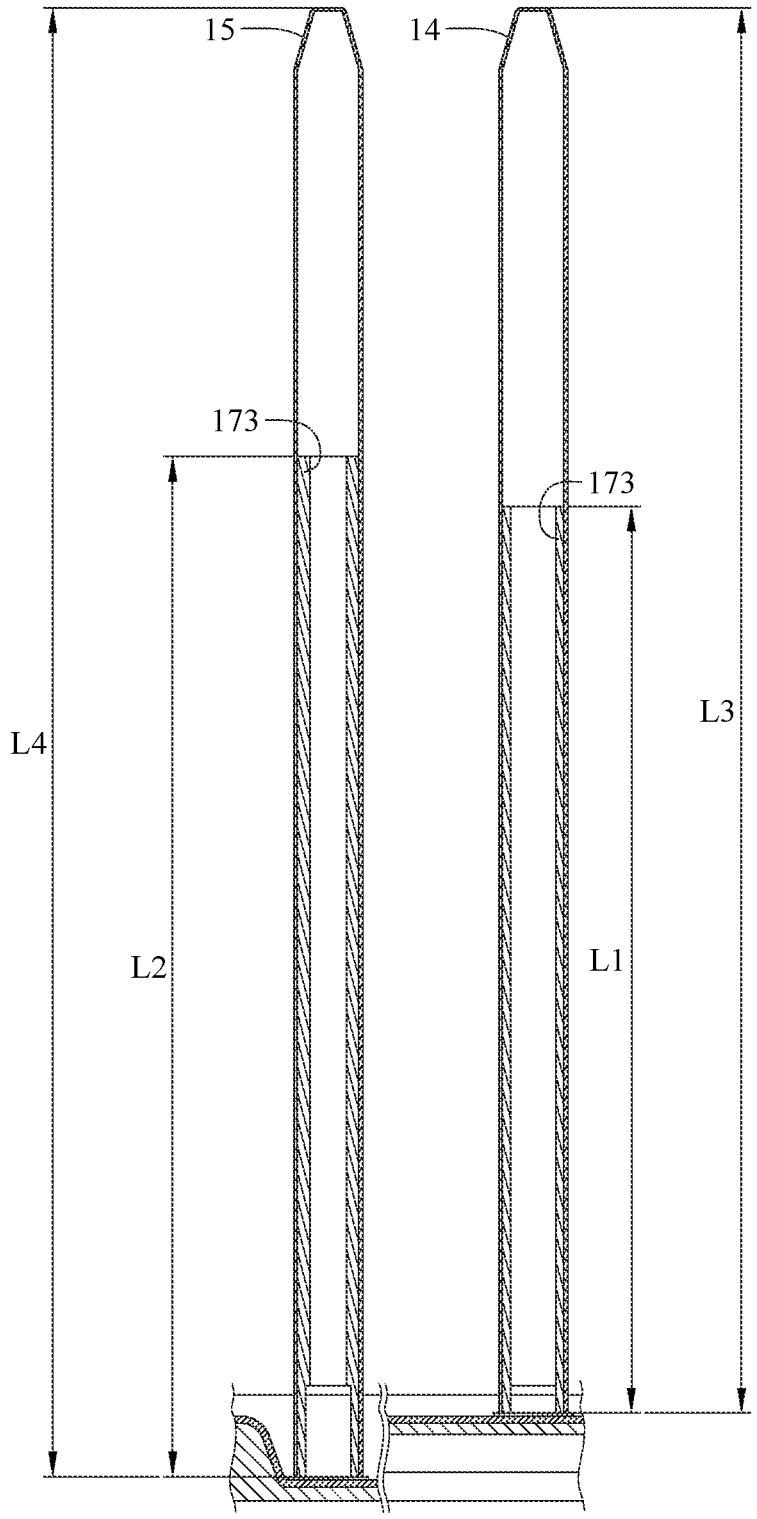
FIG. 6 is a cross-sectional view of heat pipes of the three-dimensional heat exchanger in FIG. 1.

Please refer to FIG. 6 and FIG. 7, where FIG. 6 is a cross-sectional view of heat pipes 14 and 15 of the three-dimensional heat exchanger 10 in FIG. 1. The first thermally conductive casing 11 has a lower surface 112. The lower surface 112 faces away from the upper surface 111. The first supporting structures 161 protrude from the first inner surface 1211 of the bottom plate 121, and contact the lower surface 112. The second supporting structures 162 protrude from the second inner surface 1231 of the thermally conductive protrusion structure 123, and contact the lower surface 112. The thermally conductive structures 13 are connected to a part of the second supporting structures 162.

The annular side wall 122 has a third inner surface 1221. Each of the plurality of first heat pipe 14 has a first pipe inner surface 141. Each of the second heat pipe 15 has a second pipe inner surface 151. The second capillary structure 171 is stacked on the first inner surface 1211 of the bottom plate 121, the second inner surface 1231 of the thermally conductive protrusion structure 123, the third inner surface 1221 of the annular side wall 122, the lower surface 112 of the first thermally conductive casing 11 and the first supporting structures 161. The third capillary structure 172 is stacked on the second supporting structures 162. The fourth capillary structures 173 are stacked on the first pipe inner surfaces 141 of the first heat pipes 14 and the second pipe inner surfaces 142 of the second heat pipes 15, respectively. The fifth capillary structures 174 are stacked on the second capillary structure 171, and are located at the openings O1 of the first heat pipes 14 and the openings O2 of the second heat pipes 15, respectively. Accordingly, after the working fluid absorbs the heat from the heat source to be vaporized, the working fluid can flow backwards via the capillary structures 171-174.

In this embodiment, the first capillary structure 132, the second capillary structure 171, the third capillary structure 172, the fourth capillary structures 173 and the fifth capillary structures 174 are selected from a group consisting of a metal mesh, a fiber and a sintered powder structure.

In this embodiment, the second capillary structure 171 are connected to the fourth capillary structures 173 via the fifth capillary structures 174, for example, via metallic bonding manner. The so-called "metallic bonding manner", for example, refers to a sintering process used to connect two capillary structures 171 and 173 with each other for accelerating a fluid transfer between the two capillary structures 171 and 173, thereby improving the efficiency of heat dissipation of the three-dimensional heat exchanger 10.

In this embodiment, a length L1 of each of the fourth capillary structures 173 stacked on the first heat pipes 14 and a length L2 of each of the fourth capillary structures 173 stacked on the second heat pipes 15 are larger than a half of a length L3 of each of the first heat pipes 14 and a half of a length L4 of each of the second heat pipes 15.

In this embodiment, the three-dimensional heat exchanger 10 further includes a plurality of reinforcing structures 18. The reinforcing structures 18 and the first thermally conductive casing 11 are integrally formed as a single piece, for example, via stamping, computer numerical control (CNC) or forging, and are located on the upper surface 111 of the first thermally conductive casing 11. The reinforcing structures 18 surround the through holes 113 of the first thermally conductive casing 11. The first heat pipe 14 and the second heat pipe 15 pass through the reinforcing structures 18 and the through holes 113, respectively. Accordingly, the first heat pipe 14 and the second heat pipe 15 can be more stably disposed through the first thermally conductive casing 11 via the reinforcing structures 18. Correspondingly, in the embodiment where the three-dimensional heat exchanger 10 includes the reinforcing structures 18, each of the bottom surfaces N11 and N21 may be, for example, flush with an upper surfaces of the reinforcing structures 18.

In this embodiment, the distance D1 between each of the bottom surfaces N11 and the second inner surface 1231 is equal to the distance D2 between each of the bottom surfaces N21 and the second inner surface 1231, but the disclosure is not limited thereto. In other embodiments, the distance between each of the bottom surfaces and the second inner surface may be not equal to the distance between each of the bottom surfaces and the second inner surface.

In this embodiment, the bottom surfaces N11 and N21 are located above the upper surface 111 of the first thermally conductive casing 11, and are flush with the upper surfaces of the reinforcing structures 18, but the disclosure is not limited thereto. In other embodiments, the bottom surfaces may be flush with the upper surface of the first thermally conductive casing, or may be located below the upper surface of the first thermally conductive casing and flush with the lower surface of the first thermally conductive casing.

In this embodiment, the first supporting structures 161, the second supporting structures 162, the thermally conductive structures 13 and the second thermally conductive casing 12 are, for example, integrally formed as a single piece via stamping, milling and another suitable manner, but the disclosure is not limited thereto. In other embodiments, the first supporting structures, the second supporting structures and the thermally conductive structures may be connected to the second thermally conductive casing via any suitable bonding technique such as welding, diffusion bonding, thermal pressing, soldering, brazing and adhering.

In this embodiment, the three-dimensional heat exchanger 10 includes the thermally conductive structures 13, but the disclosure is not limited thereto. In other embodiments, the three-dimensional heat exchanger may include only one thermally conductive structure.

In this embodiment, the thermally conductive structures 13 are parallel to one another, but the disclosure is not limited thereto. In other embodiments, the plurality of thermally conductive structures may be arranged radially.

In this embodiment, the thermally conductive structures 13 are, for example, rectangular prisms or bars with different lengths, but the disclosure is not limited thereto. In other embodiments, as long as the thermally conductive structures can cause desired vapor pressure drop and reduce the high liquid pressure drop caused by the capillary structures in the liquid-tight chamber S, the thermally conductive structures may be another shape.

In this embodiment, the three-dimensional heat exchanger 10 includes the first heat pipes 14 and the second heat pipes 15, but the disclosure is not limited thereto. In other embodiments, the three-dimensional heat exchanger may include only one first heat pipe and only one second heat pipe.

In this embodiment, the length L1 of each of the fourth capillary structures 173 stacked on the first heat pipes 14 and the length L2 of each of the fourth capillary structures 173 stacked on the second heat pipes 15 are larger than a half of the length L3 of each of the first heat pipes 14 and a half of each of the length L4 of the second heat pipes 15, but the disclosure is not limited thereto. In other embodiments, the length of each of the fourth capillary structures stacked on the first heat pipes and the length of each of the plurality of fourth capillary structures stacked on the second heat pipes may be less than or equal to a half of the length of each of the first heat pipes and a half of the length of each the second heat pipes.

In this embodiment, the second capillary structure 171 are connected to the fourth capillary structures 173 via the fifth capillary structures 174 by a metallic bonding manner, but the disclosure is not limited thereto. In other embodiments, the three-dimensional heat exchanger may not include the fifth capillary structures, and the fourth capillary structures may directly contact the second capillary structure.

Figure 8:
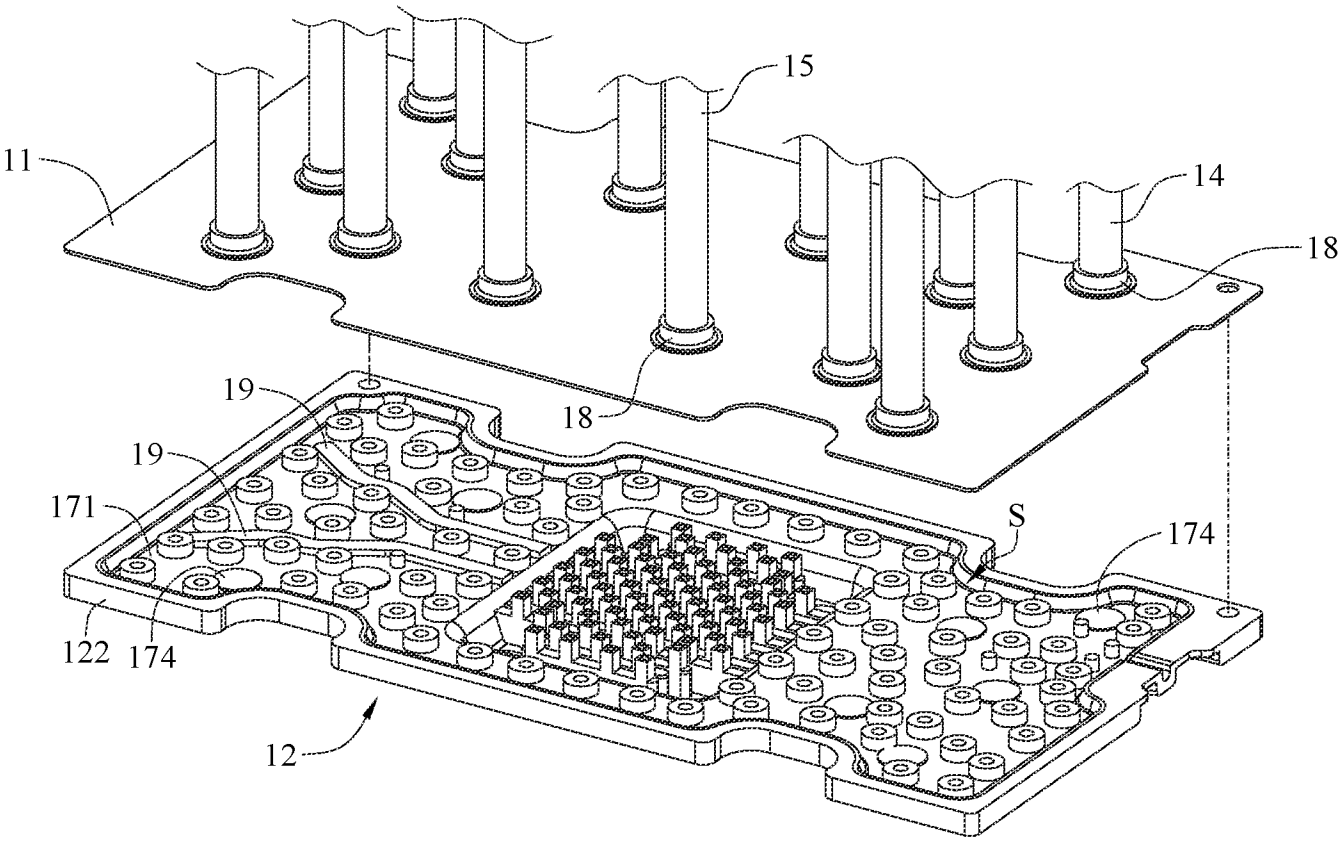
FIG. 8 is a perspective view of a three-dimensional heat exchanger according to a second embodiment of the disclosure.

Please refer to FIG. 1 to FIG. 8, where FIG. 8 is a perspective view of a three-dimensional heat exchanger 10A according to a second embodiment of the disclosure. The three-dimensional heat exchanger 10A in this embodiment is similar to the three-dimensional heat exchanger 10 in FIG. 1, and thus the following mainly introduces the differences between them, and the similar or same parts between them will not be repeated introduced hereinafter. In this embodiment, the three-dimensional heat exchanger 10A further includes a plurality of sixth capillary structures 19. The sixth capillary structures 19 are located on the first inner surface 1211 of the bottom plate 121, and are stacked on the second capillary structure 171. The sixth capillary structures 19 is selected from a group consisting of a metal mesh, a fiber and a sintered powder structure. Accordingly, after the working fluid absorbs the heat from the heat source to be vaporized, the working fluid can further flow backwards via the capillary structures 171-174 and 19.

According to the three-dimensional heat exchangers disclosed by the above embodiments, since the distance between each of the bottom surfaces of the first heat pipes and the second inner surface of the thermally conductive protrusion structure and the distance between each of the bottom surfaces of the second heat pipes and the second inner surface of the thermally conductive protrusion structure are larger than the distance between the top surface of each of the thermally conductive structures and the second inner surface of the thermally conductive protrusion structure, the working fluid absorbing the heat from the heat source to be vaporized can be accelerated to flow into the first heat pipes and the second heat pipes. Therefore, the efficiency of heat dissipation can be improved.

In addition, the distance between each of the bottom surfaces of the first heat pipes and the second inner surface of the thermally conductive protrusion structure is equal to the distance between each of the bottom surfaces of the second heat pipes and the second inner surface of the thermally conductive protrusion structure, and the bottom surfaces are flush with the upper surface of the first thermally conductive casing. Therefore, the working fluid absorbing the heat from the heat source to be vaporized can be further accelerated to flow into the first heat pipes and the second heat pipes. Thus, the efficiency of heat dissipation can be further improved.

Moreover, comparing to a case that the two capillary structures are merely in contact with each other, connecting the two capillary structures via the metallic bonding manner can further accelerate the fluid transfer between the two capillary structures, thereby improving the heat transfer efficiency of the three-dimensional heat exchanger.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A three-dimensional heat exchanger, comprising:

a first thermally conductive casing;

a second thermally conductive casing, disposed on the first thermally conductive casing, wherein the first thermally conductive casing and the second thermally conductive casing together form a liquid-tight chamber, the second thermally conductive casing comprises a bottom plate, a thermally conductive protrusion structure, and an annular side wall, the thermally conductive protrusion structure protrudes from the bottom plate toward a direction away from the first thermally conductive casing, the bottom plate has a first inner surface, the thermally conductive protrusion structure has a second inner surface, the annular side wall is connected to a periphery of the bottom plate and has a third inner surface, and the first inner surface and the second inner surface face the first thermally conductive casing;

at least one thermally conductive structure, located in the liquid-tight chamber and disposed on the thermally conductive protrusion structure, wherein the at least one thermally conductive structure has a top surface, and the top surface faces the first thermally conductive casing;

a plurality of first supporting structures and a plurality of second supporting structures, the plurality of first supporting structures protrude from the first inner surface of the bottom plate, and the plurality of second supporting structures protrude from the second inner surface of the thermally conductive protrusion structure;

a first capillary structure disposed on the at least one thermally conductive structure;

a second capillary structure disposed on the first inner surface of the bottom plate and the second inner surface of the thermally conductive protrusion structure;

at least one third capillary structure disposed on the second capillary structure and the first inner surface of the bottom plate, the at least one third capillary structure has a strip shape and disposed in a direction from the thermally conductive protrusion structure towards a corner of the second thermally conductive casing;

a fourth capillary structure and a plurality of fifth capillary structures; and at least one first heat pipe and at least one second heat pipe, disposed through the first thermally conductive casing, the at least one first heat pipe has a first pipe inner surface, the at least one second heat pipe has a second pipe inner surface, wherein the at least one first heat pipe contacts the first inner surface, the at least one second heat pipe contacts the second inner surface, an end of the at least one first heat pipe and an end of the at least one second heat pipe each have an opening and at least one notch, the opening is in fluid communication with the liquid-tight chamber, the at least one notch is located at the opening, the at least one notch is in fluid communication with the opening, the at least one notch of the at least one first heat pipe and the at least one notch of the at least one second heat pipe each have a bottom surface, the two bottom surfaces of the at least one first heat pipe and the at least one second heat pipe face the first inner surface and the second surface, respectively, the fourth capillary structure is stacked on the plurality of second supporting structures, the plurality of fifth capillary structures are stacked on the first pipe inner surface of the at least one first heat pipe and the second pipe inner surface of the at least one second heat pipe, respectively and a distance between each of the two bottom surfaces of the at least one first heat pipe and the at least one second heat pipe and the second inner surface is larger than a distance between the top surface and the second inner surface.

2. The three-dimensional heat exchanger according to claim 1, wherein the distance between the bottom surface of the at least one notch of the at least one first heat pipe and the second inner surface of the thermally conductive protrusion structure is equal to the distance between the bottom surface of the at least one notch of the at least one second heat pipe and the second inner surface of the thermally conductive protrusion structure.

3. The three-dimensional heat exchanger according to claim 2, wherein the first thermally conductive casing has an upper surface, the upper surface faces away from the liquid-tight chamber, and the two bottom surfaces of the at least one first heat pipe and the at least one second heat pipe are flush with, located above or located below the upper surface.

4. The three-dimensional heat exchanger according to claim 3, wherein the first thermally conductive casing comprises a plurality of reinforcing structures, the first thermally conductive casing has a plurality of through holes, the plurality of reinforcing structures and the plurality of through holes are located on the upper surface of the first thermally conductive casing, the plurality of reinforcing structures surround the plurality of through holes, and the at least one first heat pipe and the at least one second heat pipe penetrate through the plurality of reinforcing structures and the plurality of through holes, respectively.

5. The three-dimensional heat exchanger according to claim 4, wherein the at least one thermally conductive structure comprises a body portion, the first capillary structure is stacked on the body portion, and the top surface is located on the first capillary structure.

6. The three-dimensional heat exchanger according to claim 5, wherein the first thermally conductive casing has a lower surface, the lower surface faces away from the top surface of the first thermally conductive casing, the plurality of first supporting structures protrude from the first inner surface of the bottom plate and contact the lower surface, the plurality of second supporting structures protrude from the second inner surface of the thermally conductive protrusion structure and contact the lower surface, and the at least one thermally conductive structure is connected to a part of the plurality of second supporting structures.

7. The three-dimensional heat exchanger according to claim 6, wherein the second capillary structure is further stacked on the third inner surface of the annular side wall, the lower surface of the first thermally conductive casing and the plurality of first supporting structures.

8. The three-dimensional heat exchanger according to claim 7, wherein a length of each of the plurality of fifth capillary structures is larger than a half of a length of the at least one first heat pipe and a half of a length of the at least one second heat pipe.

9. The three-dimensional heat exchanger according to claim 8, further comprising a plurality of sixth capillary structures, wherein the plurality of sixth capillary structures are stacked on the second capillary structure, the plurality of sixth capillary structures are located at the opening of the at least one first heat pipe and the opening of the at least one second heat pipe, respectively, and the plurality of fifth capillary structures are connected to the second capillary structure via the plurality of sixth capillary structures.

10. The three-dimensional heat exchanger according to claim 9, wherein the second capillary structure is connected to the plurality of fifth capillary structures via the plurality of sixth capillary structures by a metallic bonding manner.

11. The three-dimensional heat exchanger according to claim 9, wherein the first capillary structure, the second capillary structure, the at least one third capillary structure, the fourth capillary structures, the plurality of fifth capillary structures, and the plurality of sixth capillary structures are selected from a group consisting of a metal mesh, a fiber and a sintered powder structure.

12. The three-dimensional heat exchanger according to claim 1, wherein the at least one thermally conductive structure comprises a plurality of thermally conductive structures, and the plurality of thermally conductive structures are parallel to one another.

* * * * *